US007239282B2

(12) United States Patent
Ikeda et al.

(10) Patent No.: US 7,239,282 B2
(45) Date of Patent: Jul. 3, 2007

(54) WIRING STRUCTURE OF VEHICLE-MOUNTED ANTENNA SYSTEM

(75) Inventors: Tomoki Ikeda, Tokyo (JP); Hideaki Oshima, Ibaraki-ken (JP); Makoto Ueda, Kyoto-fu (JP)

(73) Assignee: Alps Electric Co., Ltd., Tokyo (JP)

( * ) Notice: Subject to any disclaimer, the term of this patent is extended or adjusted under 35 U.S.C. 154(b) by 44 days.

(21) Appl. No.: 11/159,703

(22) Filed: Jun. 23, 2005

(65) Prior Publication Data

US 2005/0285806 A1 Dec. 29, 2005

(30) Foreign Application Priority Data

Jun. 25, 2004 (JP) ..... 2004-188708

(51) Int. Cl.
*H01Q 1/32* (2006.01)

(52) U.S. Cl. ..... 343/713

(58) Field of Classification Search ..... 343/713, 343/711, 700 MS, 767, 905, 906
See application file for complete search history.

(56) References Cited

U.S. PATENT DOCUMENTS 4,916,456 A * 4/1990 Shyu ..... 343/713

FOREIGN PATENT DOCUMENTS

JP 6-53722 2/1994
JP 8-321714 12/1996

* cited by examiner

*Primary Examiner*—Michael C. Wimer
(74) *Attorney, Agent, or Firm*—Brinks Hofer Gilson & Lione

(57) ABSTRACT

A glass plate is formed with a radiating conductor. An electronic circuit unit includes a base plate soldered to the radiating conductor to be fixed to the glass plate, a frame fixed to the base plate with screws for accommodating the circuit board, and a cover crowned on the frame. The base plate is provided with a holding piece which protrudes the inside of the frame, and a hooking piece which protrudes out of frame. The cover is provided with a holding groove. A feeder line connected to the radiating conductor is inserted between the holding piece and the glass plate. The feeder line drawn out of the frame is hooked on the hooking piece, and led to the circuit board by the holding groove.

4 Claims, 9 Drawing Sheets

WIRING STRUCTURE OF VEHICLE-MOUNTED ANTENNA SYSTEM

BACKGROUND OF THE INVENTION

1. Field of the Invention

The present invention relates to a vehicle-mounted antenna system to be mounted on the inside of a window glass of a vehicle or the like, and in particular, to a wiring structure of a feeder line which electrically connects a radiating conductor formed on an inner surface of a glass plate with a circuit board accommodated in a housing.

2. Description of the Related Art

Conventionally, there is known a vehicle-mounted antenna system in which a radiating conductor is formed on an inner surface of a rear glass or a front glass of a vehicle which faces the interior of the vehicle and an electronic circuit unit including a pre-amplifying circuit is attached to the inner surface, thereby allowing reception of circularly polarized waves, linearly polarized waves or the like transmitted from satellites or ground-based stations. This type of antenna system has advantages that the service life of the system can be extended and the risk of theft can be lessened, as compared to vehicle-mounted antenna systems installed outside vehicles such as roofs. Further, the antenna system also has an advantage that the size is small which allows wider viewing angles, even as compared to antenna systems set in the vicinity of a window glass inside the vehicle.

In this type of vehicle-mounted antenna system, an electronic circuit unit attached on an inner surface of a glass plate, such as a rear glass or a front glass, which faces the interior of a vehicle, is substantially constructed such that a circuit board provided with a pre-amplifying circuit and the like is accommodated in a housing. Also, a predetermined shape of a radiating conductor formed on the glass plate is electrically connected to the circuit board by an appropriate means so that the radiating conductor is supplied with power or supplied with signals.

As a conventional example, a vehicle-mounted antenna system of a construction in which a conductor piece is caused to protrude from an insulating housing which accommodates a circuit board, and the conductor piece is soldered to a feeding point of a radiating conductor is suggested (Japanese Unexamined Patent Application Publication No. 6-53722 (Pages 2 and 3, FIG. 1)). Since one end of the conductor piece is connected to an input part of a pre-amplifying circuit inside the housing, an electrical connection between the radiating conductor and the pre-amplifying circuit can be established by the conductor piece and the electronic circuit unit can be fixed to the glass plate.

The aforementioned conventional example is a vehicle-mounted antenna system in which power is fed to the radiating conductor by the conductor piece protruding from the housing of the electronic circuit unit. Since this antenna system is easily subjected to the influence of extraneous noises, there is a problem in that the reliability of the antenna system is lowered. Thus, a structure in which a feeder line which is not readily affected by the extraneous noises is connected to the radiating conductor can be taken into consideration. However, another problem occurs in which the attenuation of signals may increase if the feeder line connected to the feeding point of the radiating conductor is not efficiently led along a predetermined path.

As in the conventional example, in the case of an antenna system in which the electronic circuit unit as an integral part is fixed to the glass plate by soldering or the like, there is also a problem in that maintenance is not easy because of the complexity for removing the electronic circuit unit from the glass plate or attaching it thereto.

SUMMARY OF THE INVENTION

The present invention has been made in view of the problems inherent in the conventional antenna system, and it is an object of the present invention to provide a wiring structure which enhances the reliability of a vehicle-mounted antenna system mounted on the inner surface of a window glass which faces the interior of a vehicle, thereby easily performing maintenance as well.

In order to achieve the above object, according to the present invention, there is provided a wiring structure of the vehicle-mounted antenna system which includes: a glass plate disposed in a vehicle as a window glass; a radiating conductor formed on an inner surface of the glass plate which faces the interior of the vehicle; a coaxial feeder line having one end connected to a feeding point of the radiating conductor; a base plate made of sheet metal and fixed to the inner surface of the glass plate; a circuit board to which the other end of the feeder line is connected; and a housing attached to the base plate after accommodating the circuit board. The base plate is provided with a holding piece which is spaced apart from the glass plate so as to protrude into the housing and faces the glass plate, and a portion of the feeder line which extends along the glass plate from the one end of the feeder line is engaged with the holding piece.

If the holding piece is provided in the base plate to be fixed to the glass plate as such, since the feeder line having one end connected to the feeding point of the radiating conductor is inserted between the holding piece and the glass plate and the position is regulated, the feeder line can be efficiently led along a desired path, thereby enhancing the reliability of the antenna system. Further, since an attachment structure can be employed in which the housing having the circuit board accommodated therein is fixed by screws to the base plate which has been fixed to the glass plate in advance, the complex removal work or attachment work during checking or replacement of the circuit board need not be performed, so that the maintenance becomes easy.

In the above-described wiring structure of the vehicle-mounted antenna system, preferably, the base plate is provided with a hooking piece which is spaced apart from the glass plate so as to protrude out of the housing, a portion of the feeder line which is led out of the housing is hooked on the hooking piece. With this construction, since the position of the feeder line can be regulated by the hooking piece even outside the housing, the feeder line can be more reliably led along a predetermined path.

In the above-described wiring structure of the vehicle-mounted antenna system, preferably, the housing includes a frame made of sheet metal which surrounds the circuit board and hold the circuit board, and is detachably fixed to the base plate, and a cover which is made of sheet metal and is crowned on the frame so as to cover the circuit board. With this construction, the cost of the housing can be easily reduced and the circuit board can be simply assembled into the frame before being crowned with the cover. In this case, if a peripheral portion of the cover is provided with a bent piece which fits on the frame, and a portion of the bent piece is provided with a holding groove for positioning a portion in proximity of the other end of the feeder line, the cover can be crowned on the frame with a sufficient large attachment strength without causing any problems to the leading of the feeder line.

In the above-described wiring structure of the vehicle-mounted antenna system, preferably, the other end of the feeder line is connected to the circuit board by a connector. With this construction, since connection of the feeder line to the circuit board or disconnection of the feeder line from the circuit board can be simply performed, working efficiency greatly improves during working or maintenance of the antenna system.

According to the present invention, in the wiring structure of a vehicle-mounted antenna system to be mounted on the inner surface of a window glass which faces the interior of a vehicle, the base plate to be fixed to the glass plate is provided with a holding piece, and the position can be regulated by inserting the feeder line between the holding piece and the glass plate. Therefore, the feeder line can be efficiently led along a predetermined path. Further, since an attachment structure can be employed in which the housing having the circuit board accommodated therein is fixed by screws to the base plate which has been fixed to the glass plate in advance, a complex removal work or attachment work during checking or replacement of the circuit board need not be performed, so that the reliability of vehicle-mounted antenna system can be improved and the maintenance thereof can be easily performed.

DESCRIPTION OF THE PREFERRED EMBODIMENT

Figure 1A:
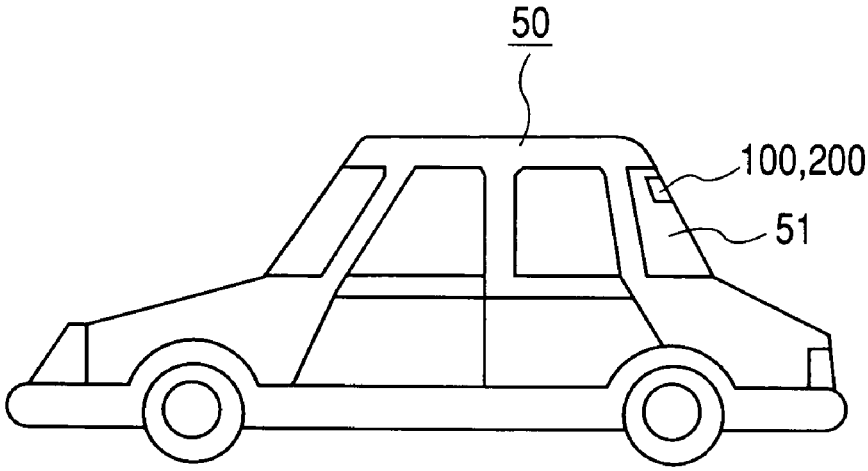
FIG. 1 is an explanatory view showing a mounting position of a vehicle-mounted antenna system according to embodiments of the present invention.
Figure 1B:
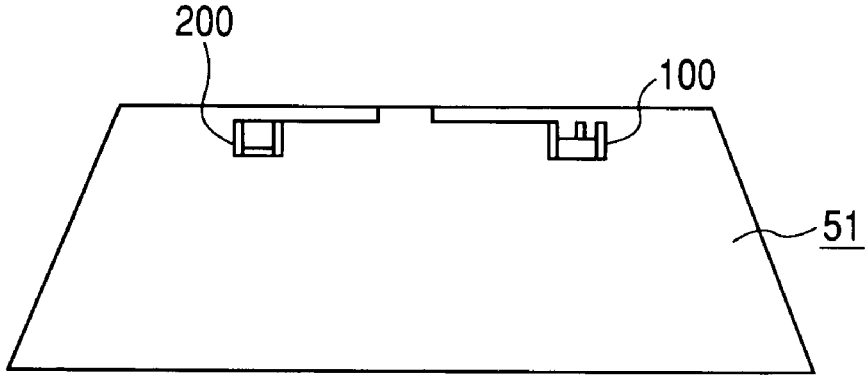
Figure 2:
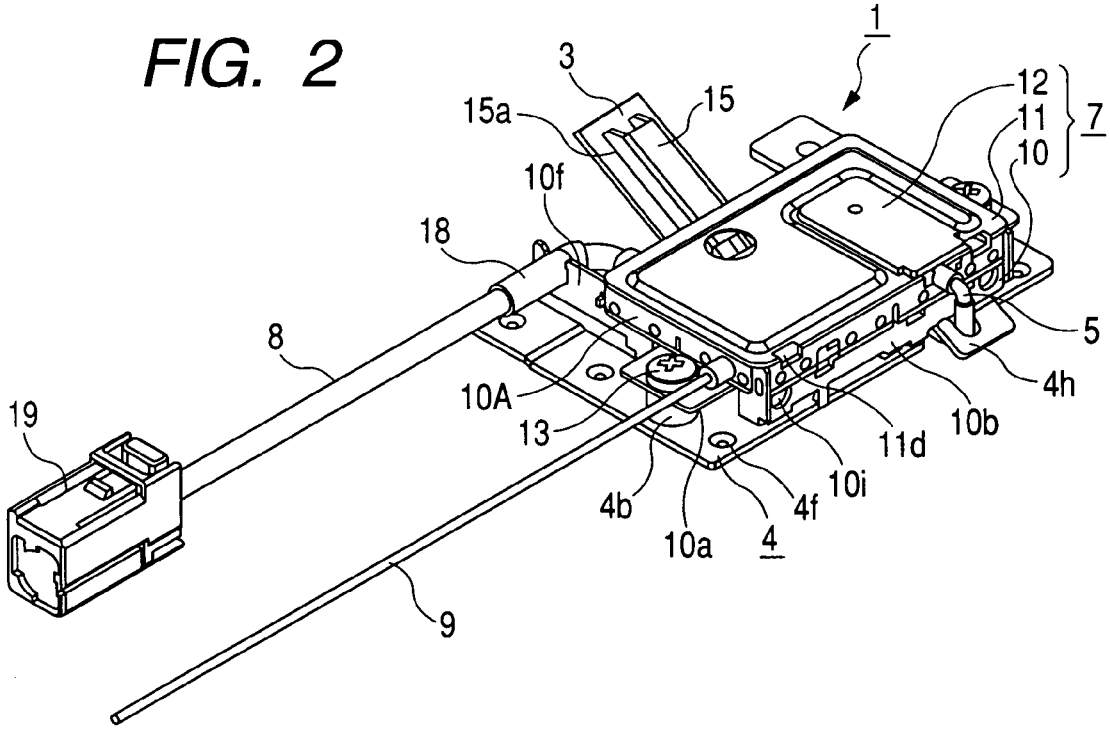
FIG. 2 is a perspective view showing an electronic circuit unit of a ground-based station antenna device constituting the vehicle-mounted antenna system.
Figure 3:
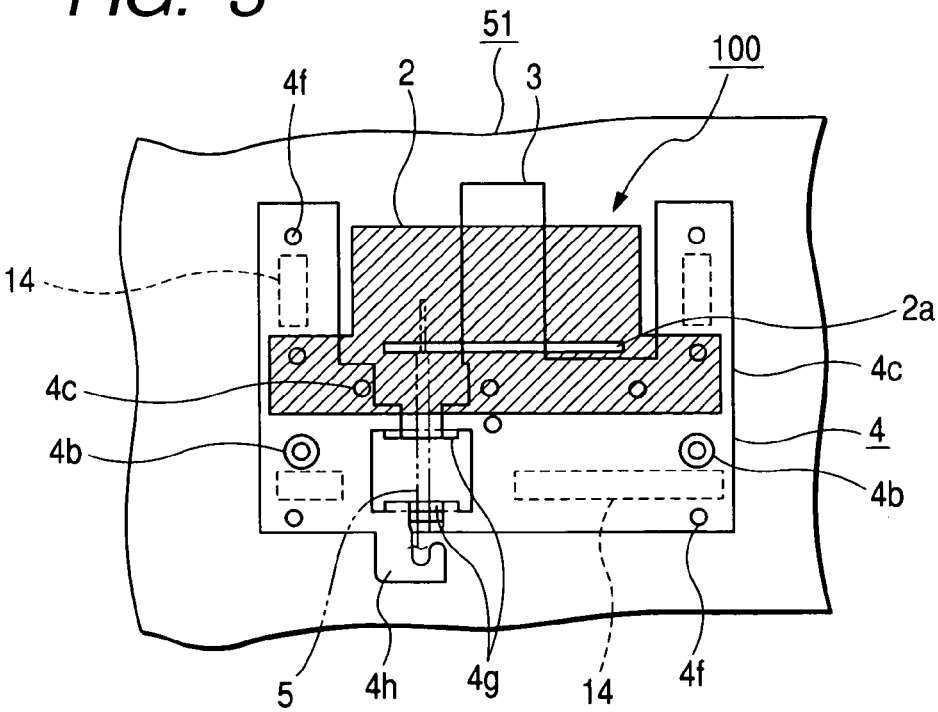
FIG. 3 is an explanatory view showing the positional relationship between a base plate and a radiating plate of the vehicle-mounted antenna system.
Figure 4:
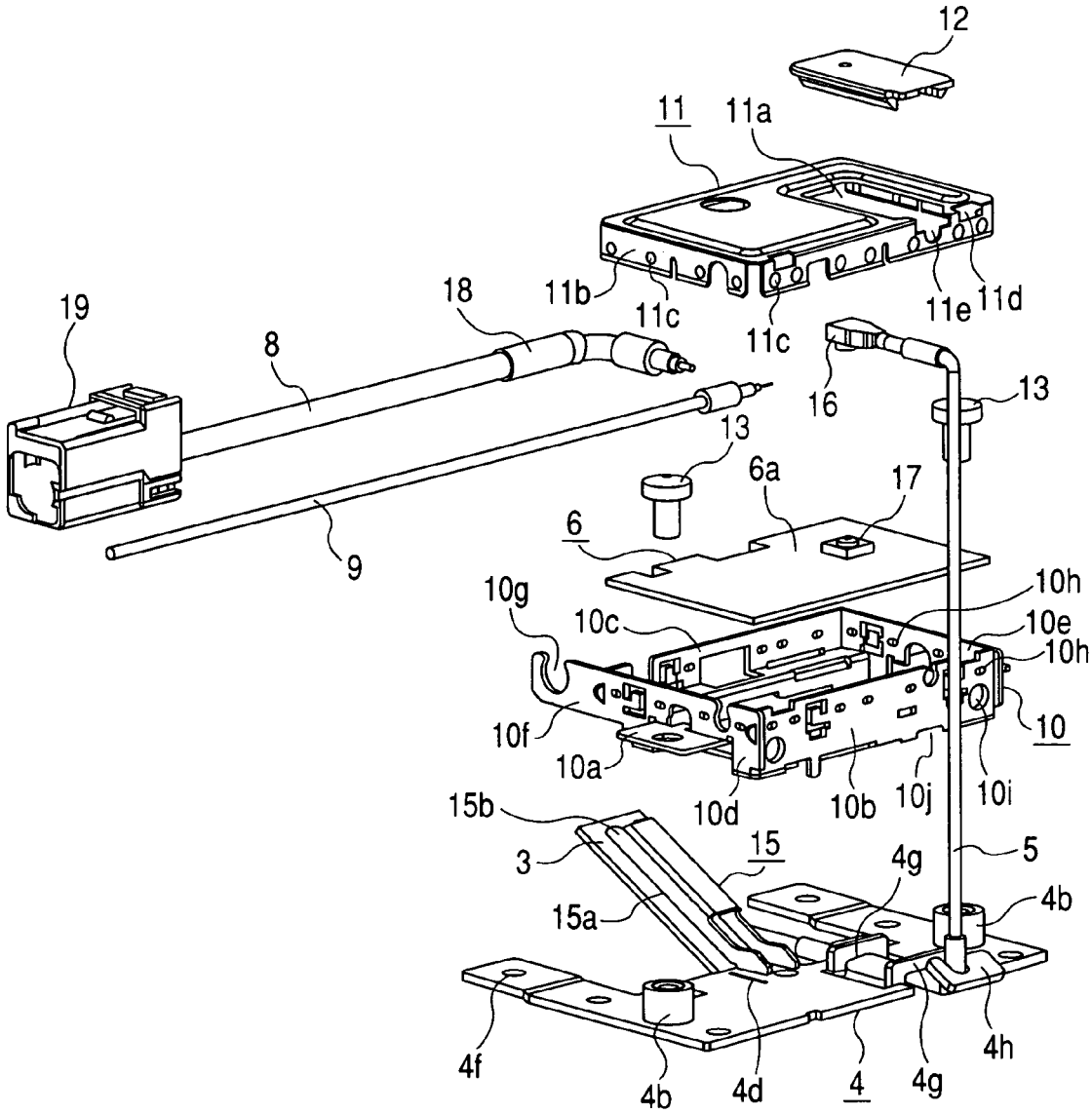
FIG. 4 is an exploded perspective view of the electronic circuit unit shown in FIG. 2.
Figure 5:
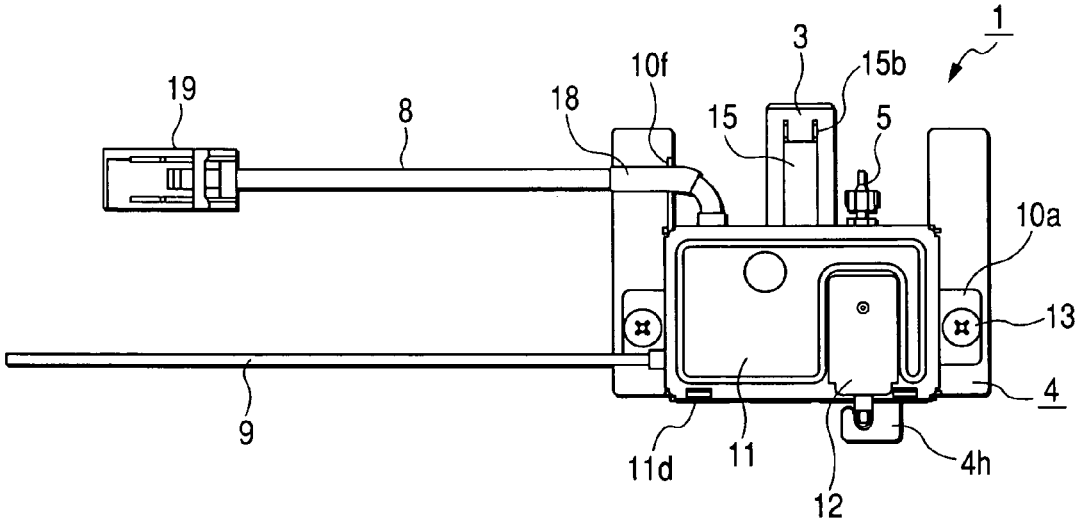
FIG. 5 is a plan view of the electronic circuit unit shown in FIG. 2.
Figure 6:
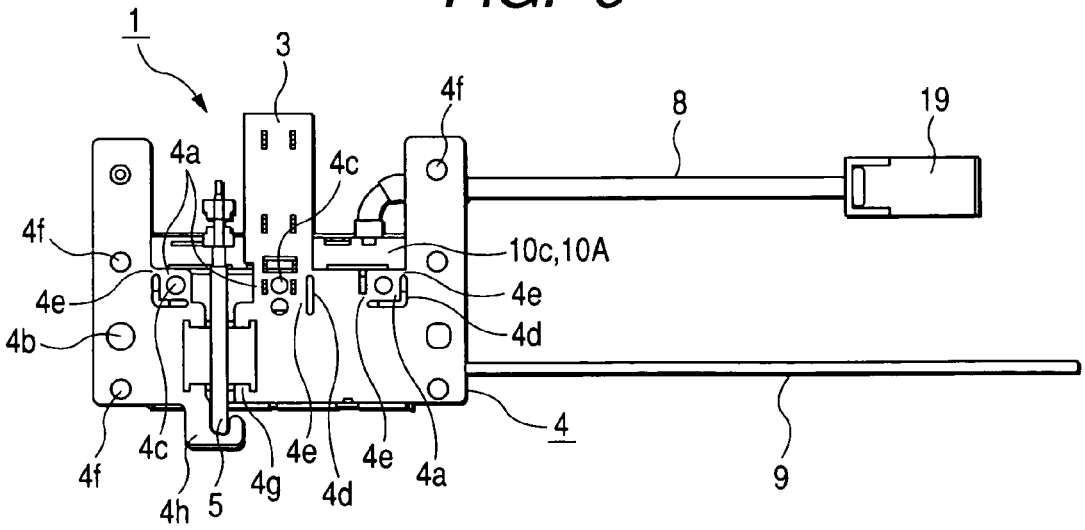
FIG. 6 is a bottom view of the electronic circuit unit shown in FIG. 2.
Figure 7:
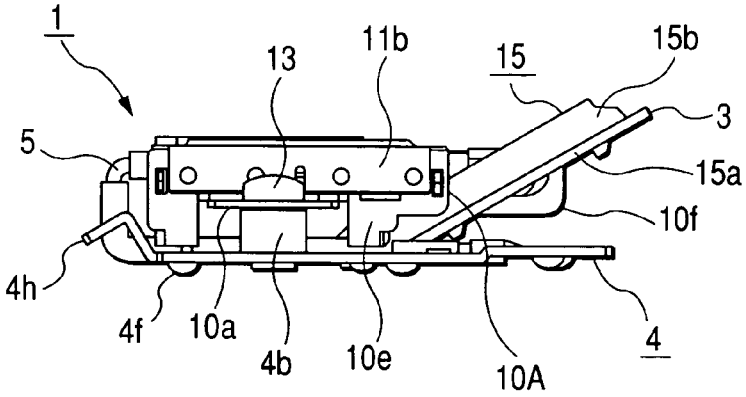
FIG. 7 is a side view of the electronic circuit unit shown in FIG. 2.
Figure 8:
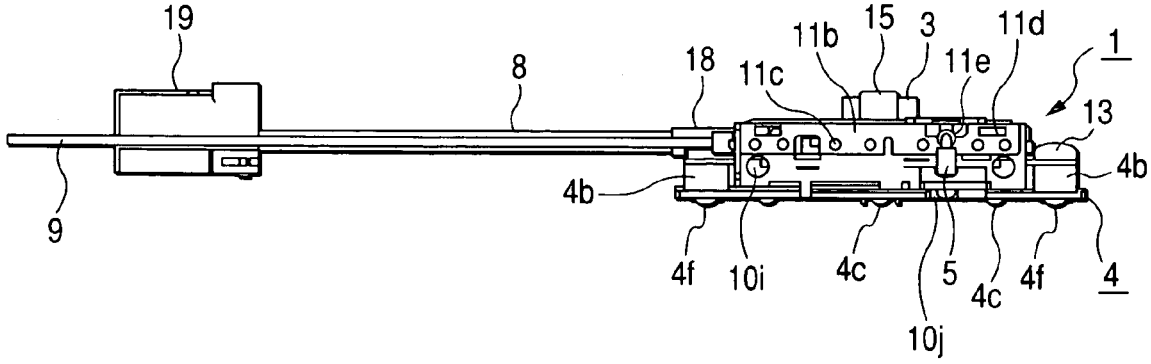
FIG. 8 is a side view of the electronic circuit unit shown in FIG. 2 as seen from a direction different from FIG. 7.
Figure 9:
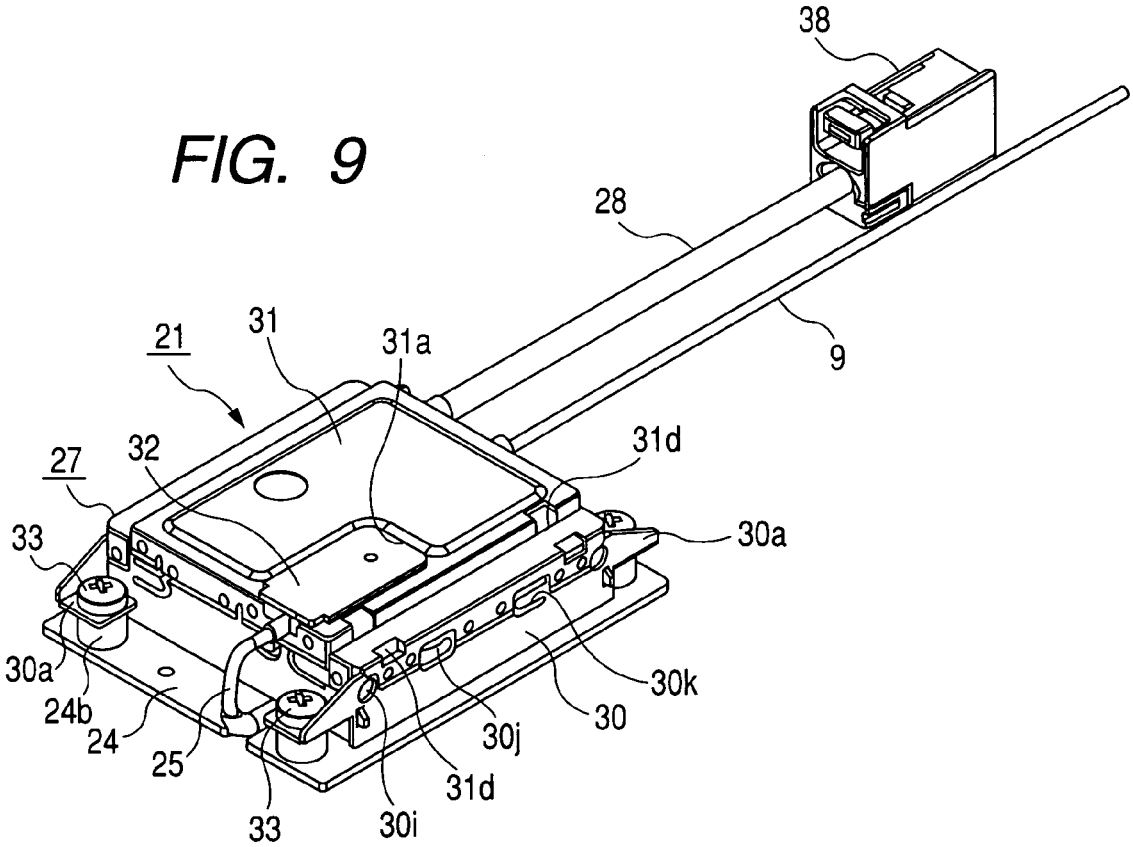
FIG. 9 is a perspective view showing a satellite antenna device constituting the vehicle-mounted antenna system.
Figure 10:
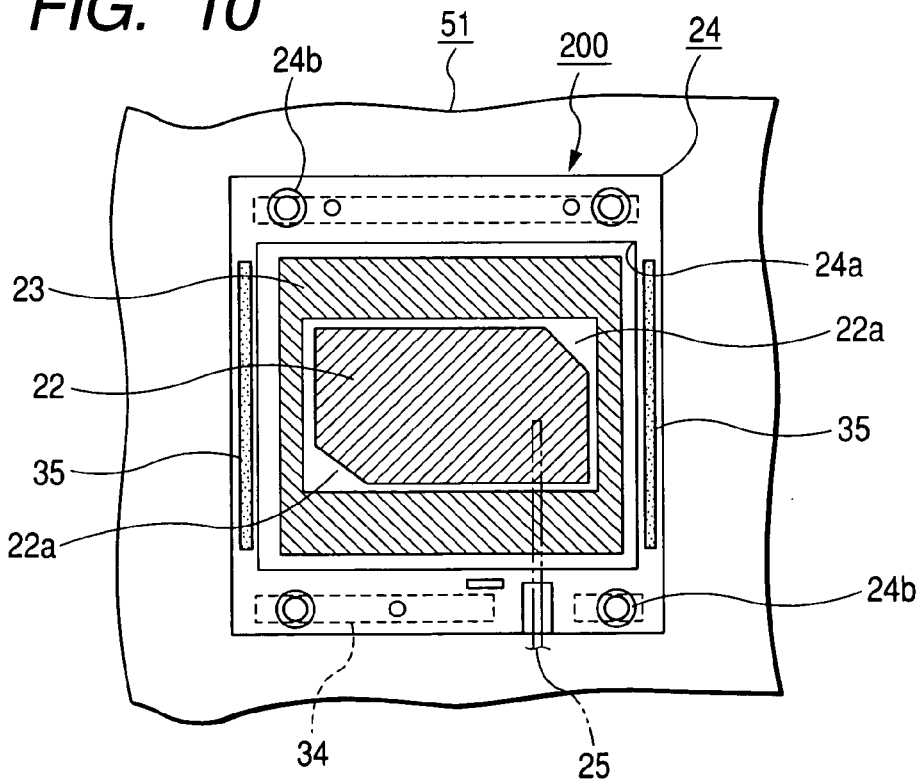
FIG. 10 is an explanatory view showing the positional relationship between a base plate and a radiating conductor of the electronic circuit unit shown in FIG. 9.
Figure 11:
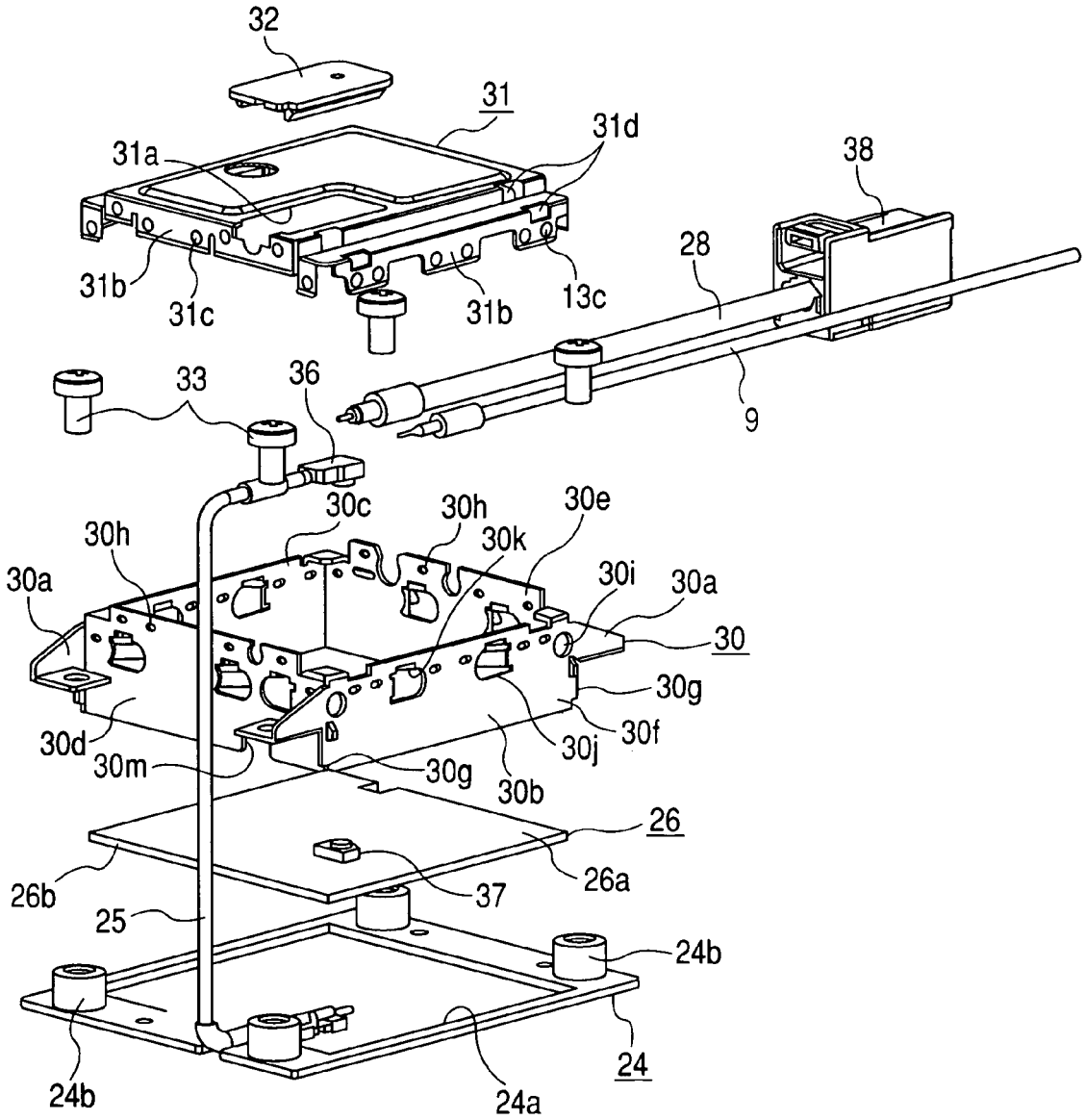
FIG. 11 is an exploded perspective view of the electronic circuit unit shown in FIG. 9.
Figure 12:
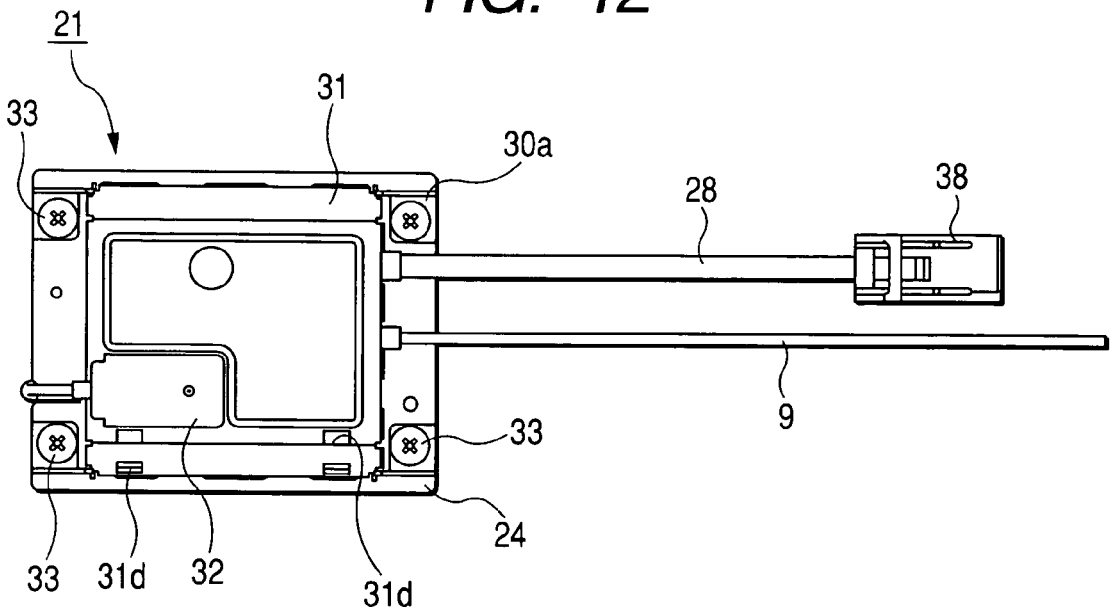
FIG. 12 is a plan view of the electronic circuit unit shown in FIG. 9.
Figure 13:
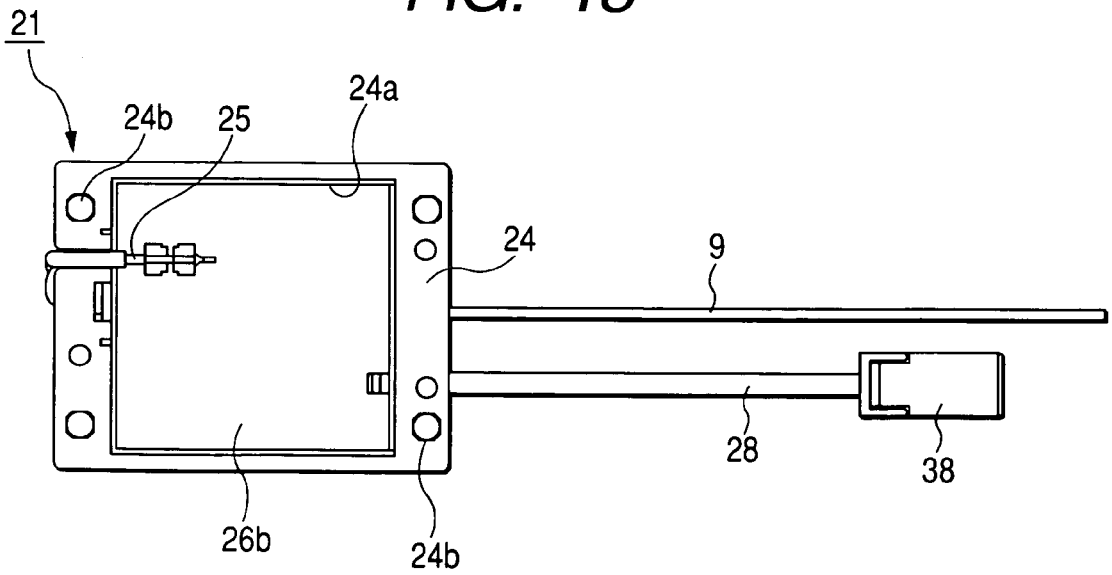
FIG. 13 is a bottom view of the electronic circuit unit shown in FIG. 9.
Figure 14:
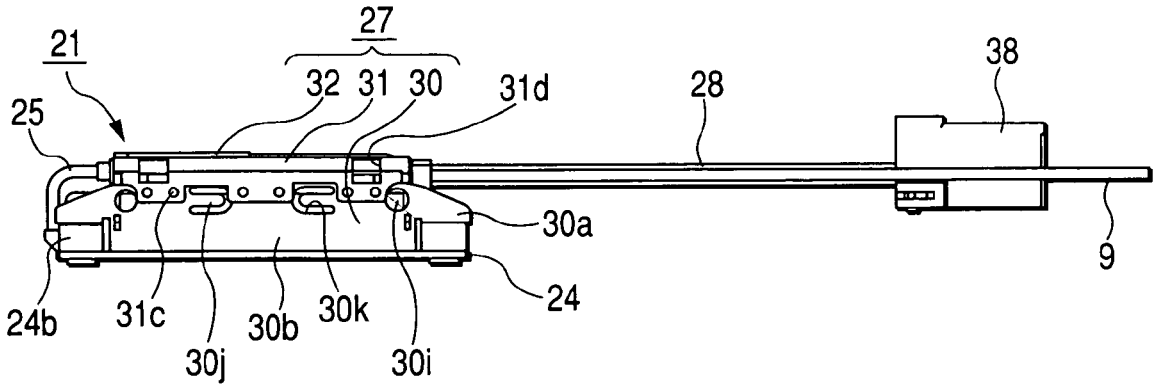
FIG. 14 is a side view of the electronic circuit unit shown in FIG. 9.
Figure 15:
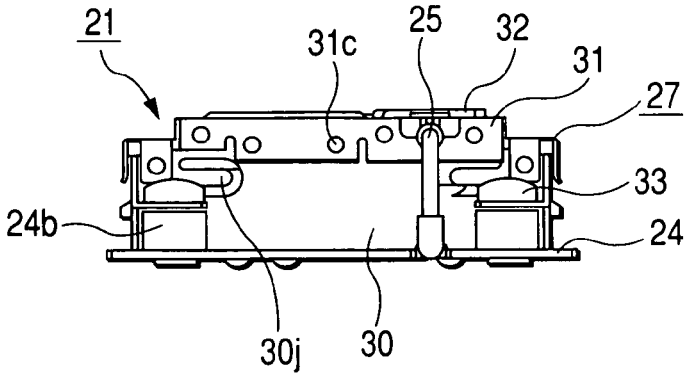
FIG. 15 is a side view of the electronic circuit unit shown in FIG. 9 as seen from a direction different from FIG. 14.

Preferred embodiments of the present invention will now be described with reference to the drawings. FIG. 1 is an explanatory view showing a mounting position of a vehicle-mounted antenna system according to embodiments of the present invention, wherein FIG. 1A is a side view of a vehicle, and FIG. 1B is a front view of a rear glass as seen from the interior of the vehicle. Further, FIGS. 2 to 8 show a ground-based station antenna device constituting the vehicle-mounted antenna system, wherein FIG. 2 is a perspective view showing an electronic circuit unit of the ground-based station antenna device; FIG. 3 is an explanatory view showing the positional relationship between a base plate and a radiating conductor; FIG. 4 is an exploded perspective view of the electronic circuit unit; FIG. 5 is a plan view of the electronic circuit unit; FIG. 6 is a bottom view of the electronic circuit unit; FIG. 7 is a side view of the electronic circuit unit; and FIG. 8 is a side view of the electronic circuit unit as seen from a direction different from FIG. 7, with illustration of a feeder line and a connector cover omitted. Further, FIGS. 9 to 15 show a satellite antenna device constituting the vehicle-mounted antenna system, wherein FIG. 9 is a perspective view showing an electronic circuit unit of a satellite antenna device; FIG. 10 is an explanatory view showing the positional relationship between a base plate and a radiating conductor of the electronic circuit unit; FIG. 11 is an exploded perspective view of the electronic circuit unit; FIG. 12 is a plan view of the electronic circuit unit shown; FIG. 13 is a bottom view of the electronic circuit unit; FIG. 14 is a side view of the electronic circuit unit; and FIG. 15 is a side view of the electronic circuit unit as seen from a direction different from FIG. 14.

As shown in FIG. 1A and FIG. 1B, the vehicle-mounted antenna system according to the present embodiment generally includes a ground-based station antenna device 100 and a satellite antenna device 200 which are placed side by side on an inner surface of a rear glass 51 of the vehicle 50 which faces the interior of the vehicle. The ground-based station antenna device 100 can receive a linearly polarized wave (a vertically polarized wave) transmitted from a ground-based station, and the satellite antenna device 200 can receive a circularly polarized wave transmitted from a satellite. The vehicle-mounted antenna system makes the ground-based station antenna device 100 and the satellite antenna device 200 to operate in a mutually complementary manner so that high receiving sensitivity can be obtained at all times.

First, to explain the ground-based station antenna device 100, the ground-based station antenna device 100 is a slot antenna, and is mainly constituted of an electronic circuit unit 1 attached to the inner surface of the rear glass 51 which faces the interior of the vehicle, and a radiating conductor 2 formed on the inner surface of the rear glass 51. The electronic circuit unit 1 includes a base plate 4 made of sheet metal, which has a reflecting plate 3 protruding therefrom and is fixed to the inner surface of the rear glass 51, a circuit board 6 electrically connected to the radiating conductor 2 by a coaxial feeder line 5, a housing 7 made of sheet metal, which is mounted on the base plate 4 after accommodating the circuit board 6, a coaxial cable (output cable) 8 having one end connected to the circuit board 6 and the other end connected to a receiver (not shown), and a power-supplying DC cable 9.

Here, a housing 7 is constituted of a frame 10 made of sheet metal which surrounds the circuit board to hold the circuit board 6, a cover 11 which is crowned on the frame 10 so as to cover the circuit board 6, and a connector cover 12 made of sheet metal which closes a cutout 11*a* of the cover 11. Two spots (outwardly protruding pieces 10*a*) of the frame 10 are fixed to the base plate 4 with fixing screws 13. That is, the electronic circuit unit 1 of the ground-based station antenna device 100 has the base plate 4 which detachably fixes the housing 7. The base plate 4 is securely fixed to the rear glass 51 with a wet curable resin 14 (see FIG. 3).

To explain the construction of respective parts of the ground-based station antenna device 100 in detail, the radiating conductor 2 is a conductive layer made of a good conductive metal such as Ag. As shown in FIG. 3, the radiating conductor 2 is formed with a predetermined size of a slot 2*a*. Two spots of the radiating conductor 2 facing each other with the slot 2*a* sandwiched therebetween becomes feeding points to which one end of the feeder line 5 is connected. Further, since three spots of the radiating conductor 2 are soldered to a soldering portion 4*a* (see FIG. 6) of the base plate 4, the base plate 4 functions as a ground electrically.

The reflecting plate 3 is a rectangular metallic flat plate which obliquely extends from the base plate 4 and faces the radiating conductor 2. The gain in a low wave angle direction can be improved by radio waves being reflected by the reflecting plate 3. An angle holding member 15 which is caulked to the reflecting plate 3 and the base plate 4 around the reflecting plate 3 is attached to the back surface of the reflecting plate 3. The angle holding member 15 is formed by bending a metallic flat plate which has been blanked in a predetermined shape, and has a pair of abutting side edges 15*a* for setting the back surface of the reflecting plate 3 and the flat surface of the base plate 4 to a desired relative positional relationship. That is, the abutting side edges 15*a* are side edges which extend along the back surface of the reflecting plate 3 from the flat surface of the base plate 4. Since the abutting side edges 15*a* are cutting lines at the time of stamping working and have high dimensional accuracy, the inclined angle of the reflecting plate 3 with respect to the base plate 4 can be defined by causing the abutting side edges 15*a* to abut against the flat surface of the base plate 4 and the back surface of the reflecting plate 3. Further, by bending opposite side edges of a metallic flat plate, which uses the pairs of abutting side edges 15*a* as opposite side edges, substantially at a right angle to the extending direction thereof, the angle holding member 15 is formed with a pair of upright portions 15*b* which extends the respective abutting side edges 15*a* to face each other. The attachment of this angle holding member 15 increases the mechanical strength of the reflecting plate 3, which suppresses the occurrence of any undesired deformation.

The base plate 4 is provided with three soldering portions 4*a*, and two female threads 4*b* erected therefrom. As shown in FIG. 6, the center of each of the soldering portions 4*a* is formed with a hemispherical bulging portion 4*c* which protrudes toward the radiating conductor 2. These bulging portions 4*c* are brought into abutment against the radiating conductor 2, so that solder stay spaces are defined around the respective bulging portions 4*c*. Further, a cutout 4*d* of an L-shape, an I-shape, a circular shape, or the like is formed around each of the soldering portions 4*a* to define a connecting portion between each of the soldering portions 4*a* and the other portion of the base plate 4 as a small space 4*e*. As a result, since the heat to be supplied at the time of a heating work for solder-connecting the soldering portions 4*a* to the radiating conductor 2 does not conduct to an undesired region, the solder connection can be efficiently performed in a short time.

Further, the base plate 4 is provided with height adjusting portions 4*f* which protrude toward the rear glass 51 at plural spots away from the soldering portions 4*a*. These height adjusting portions 4*f* are formed in the shape of a hemisphere having almost the same size as the bulging portions 4*c*. Since this enables the base plate 4 to face the rear glass 51 in a point contact therewith, the bulging portions 4*c* of the soldering portions 4*a* can be reliably brought into abutment against the radiating conductor 2 at the time of the attachment of the base plate 4, thereby avoiding any occurrence of undesired floating. In addition, as shown in FIG. 3, although the base plate 4 is fixed to the rear glass 51 with the wet curable resin 14, since the base plate 4 has soldering portions 4*a* soldered to the radiating conductor 2 at the time of attachment thereof, it is unnecessary to perform temporary fixing until the wet curable resin 14 has been cured with double-sided adhesive tape, or the like.

As shown in FIGS. 3 and 6, the base plate 4 is provided with a pair of holding pieces 4*g* which stands upright into the frame 10. Since these holding pieces 4*g* faces the rear glass 51 with predetermined spacing which fixes the base plate 4, the feeder line 5 can be inserted and positioned between the rear glass 51 and the holding piece 4*g*. Moreover, the base plate 4 is provided with a hook-shaped hooking piece 4*h* which protrudes to the outside of the frame 10. The spacing between the rear glass 51 having the base plate 4 fixed thereto and the hooking piece 4*h* is slightly larger than the spacing between the rear glass and the holding piece 4*g*, so that the feeder line 5 led out of the frame 10 can be retained to the hooking piece 4*h* to be positioned.

The feeder line 5 extends along the inner surface of the rear glass 51 from one end of the radiating conductor 2 soldered to the feeding point of the radiating conductor 2 and is drawn out of the frame 10. Since the extending portion of the feeder line 5 is inserted between the pair of holding pieces 4*g* and the rear glass 51 and the position is regulated, the feeder line 5 on the rear glass 51 can be efficiently led along a desired path. Further, since the feeder line 5 drawn out of the frame 10 can be simply positioned by being retained to the hooking piece 4*h*, the feeder line 5 can be efficiently led out of the frame 10. As shown in FIG. 4, a connector 16 is attached to the other end of the feeder line 5. The connector 16 is connected to a connector 17 on the circuit board 6 which faces the cutout 11*a* of the cover 11, whereby the other end of the feeder line 5 is connected to an input part of a pre-amplifying circuit.

As shown in FIG. 4, the frame 10 is mainly consisted of a pair of opposite side walls 10*b* and 10*c*, and a pair of opposite side walls 10*d* and 10*e*. The longitudinal ends of the side walls 10*d* and 10*e* are respectively provided with outwardly protruding pieces 10*a* composed of a cut and bent portion, and an arm 10*f* is provided at one longitudinal end of the side wall 10*d* to extend therefrom. As shown in FIG. 7, the frame 10 has a larger diameter portion 10A at the upper portion (in the drawing) which faces the cover 11. The larger diameter portion 10A is formed to have a larger diameter than a lower portion (in the drawing) of the frame which faces the base plate 4. Specifically, one longitudinal end of each of the side walls 10*d* and 10*e* is provided with a protruding portion, and an opening end of the frame 10 at the cover 11 takes a widened shape by bending the side wall 10*c* in the shape of a step. Also, since the circuit board 6 is accommodated in the larger diameter portion 10A, a wide installation space for the circuit board 6 can be ensured within the frame 10 without increasing the size of the frame 10 or obstructing a normal operation of the reflecting plate 3. In addition, in the larger diameter portion 10A, a plurality of small holes 10*h* (see FIG. 4) are formed in the side wall 10*b* to 10*e*.

By fastening the fixing screw 13, which has passed through the outwardly protruding piece 10*a*, to the female screw 4*b*, the frame 10 is fixed by screws to the base plate 4 which has been fixed to the rear glass 51 in advance. As shown in FIG. 1A, since the rear glass 51 is assembled into the vehicle 50 as a window glass which is inclined with respect to the ground, when the frame 10 is fixed to the rear glass 51 by the base plate 4, the side wall 10*b* becomes a bottom region which is disposed on the ground side. Therefore, as shown in FIG. 8, the side wall 10*b* is provided with two circular drain holes 10*i* which communicate the internal space with the external space. These drain holes 10*i* rapidly drain to the outside water drops which have penetrated into the internal space defined by the base plate 4, the rear glass 51, the frame 10 and the back surface of the circuit board 6 so that the water drops do not remain in the internal space. Further, the side wall 10*b* of the frame 10 is provided with a relief groove 10*j* which allows the feeder line 5 to be led to the outside, at a location adjacent the hooking piece 4*h* of the base plate 4.

The arm 10*f* extending from the side wall 10*d* of the frame 10 is for retaining the coaxial cable 8. The arm 10*f* is formed with a cutout groove 10*g* whose opening end is relatively narrow. A thermal contraction tube 10*g* that shields the coaxial cable 8 is press-fitted into the cutout groove 10*g* so that the coaxial cable 8 can be hooked on the arm 10*f* at one touch, and an inner conductor and outer conductor of the coaxial cable 8 can be reliably protected. This can stabilize the posture of the coaxial cable 8 during assembling work and avoid damage to a connected portion of the coaxial cable 8 which may be caused when a tension acts on the coaxial cable 8. Further, the arm 10*f* composed of a metallic piece is properly deformed so that the posture of the coaxial cable 8 can be simply modified.

As shown in FIG. 4, one surface of the circuit board 6 becomes a component mounting surface 6*a* on which various electronic components (not shown) are mounted. The other end of the feeder line 5 having one end connected to the radiating conductor 2 is connected to the component mounting surface 6*a* by the connectors 16 and 17 which make a pair. That is, the other end of the feeder line 5 is connected to an input part of a pre-amplifying circuit. Further, one end of the coaxial cable 8 and one end of the DC cable 9 are respectively soldered to the component mounting surface 6*a*, and a connector 19 is attached to the other end of the coaxial cable 8. A plurality of spots of a peripheral edge of the component mounting surface 6*a* is soldered to the frame 10. This causes the frame 10 to electrically function as a ground, and the circuit board 6 and the frame 10 to be mechanically coupled with each other.

Since the cover 11 is provided with the cutout 11*a* which is covered with the connector cover 12, and the connecter 17 is allowed to face the cutout 11*a*, the connector 16 of the feeder line 5 can be connected to the connector 17 at the circuit board 6 in a state where the cover 11 crowns the frame 10 which accommodates and the holds the circuit board 6. Almost the entire periphery of the cover 11 is provided with a bent piece 11*b* which fits on the side walls 10*b* to 10*e* of the frame 10. The bent piece 11*b* is provided with a number of small engaging protrusions 11*c* which protrude inwardly. These small engaging protrusions 11*c* are arranged at positions corresponding to the small holes 10*h* of the frame 10, and the respective small engaging protrusions 11*c* can be press-fitted into the corresponding small holes 10*h* by the elasticity of the bent piece 11*b*. Accordingly, the frame 10 can be simply crowned with the cover 11 by snap fitting. In addition, the circuit board 6 is assembled into the frame 10 before being crowned with the cover 11 so that the assembling work of the circuit board 6 can be easily performed.

The cover 11 is also provided at bent piece 11*b* adjacent to the cutout 11*a* with a holding groove 11*e* as shown in FIG. 8. The holding groove 11*e* is for allowing a portion in proximity of the end of the feeder line 5 at the connector 16 to be inserted and positioned thereinto. This enables the feeder line 5 to be led by the hooking piece 4*h* to be simply and reliably disposed in the cutout 11*a*. Further, there is no fear that the feeder line 5 will slip out of the holding groove 11*e* because the opening end of the holding groove 11*e* is closed when the connector 12 is attached to the cover 11.

When the frame 10 crowned with the cover 11 is fixed to the rear glass 51 by the base plate 4, and since the region of the cover 11 around the side wall 10*b* of the frame 10 becomes a bottom region to be disposed on the ground side, the cover 11 is provided at two spots of the region with drain holes 11*d*. These drain holes 11*d* rapidly drain to the outside water drops which have penetrated into the internal space defined by the component mounting surface 6*a* of the circuit board 6, the cover 11, and the connector cover 12 so that the water drops do not remain in the internal space.

The process of assembling the ground-based station antenna device 100 constructed as above will now be described below. First, the radiating conductor 2 is formed on the inner surface of the glass plate to be the rear glass 51, one end of the feeder line 5 is soldered to the feeding point of the radiating conductor 2, and the soldering portions 4*a* of the base plate 4 are soldered to the radiating conductor 2 at predetermined locations. At this time, a portion in proximity of the end of the feeder line 5 is inserted and positioned between the holding piece 4*g* of the base plate 4 and the glass plate. Further, the wet curable resin 14 is caused to adhere to the bottom surface of the base plate 4 in advance. Next, the frame 10 is fixed to the female screw 4*b* of the base plate 4 with the fixing screw 13. It is noted herein that the circuit board 6 is assembled into the frame 10 in advance to solder one end of each of the coaxial cable 8 and the DC cable 9, and is crowned with the cover 11. Further, when the frame 10 is fixed to the base plate 4 with screws, the feeder line 5 is drawn out of the frame 10 using the relief groove 10*j* of the side wall 10*b*. Then, after the frame 10 is fixed to the base plate 4, the feeder line 5 hooked on the hooking piece 4*h* is led into the cutout 11*a* of the cover 11 by the holding groove 11*e*. Then, after the connector 16 attached to the other end of the feeder line 5 is connected to the connector 17 at the circuit board 6 which faces the cutout 11*a*, the connector cover 12 is attached to the cover 11 to cover the cutout 11*a*, thereby completing the attachment of the electronic circuit unit 1 to the glass plate to the rear glass 51.

Next, the satellite antenna device 200 will be described. The satellite antenna device 200 is a patch antenna, and is mainly constituted of an electronic circuit unit 21 attached to the inner surface of the rear glass 51 which faces the interior of the vehicle and a radiating conductor 22 and a ground conductor 23 formed on the inner surface of the rear glass 51. The electronic circuit unit 21 includes a base plate 24 made of sheet metal which is fixed to the inner surface of the rear glass 51, a circuit board 26 which is electrically connected to the radiating conductor 22 and the ground conductor 23 by a coaxial feeder line 25, a housing 27 made of sheet metal which accommodates the circuit board 26 and is attached to the base plate 24, and a coaxial cable 28 (an input/output cable) having one end connected to the circuit board 26 and the other end connected to an external receiver (not shown), and the DC cable 9 for supplying power to the ground-based station antenna device 100.

It is noted herein that the housing 27 is constituted of a frame 30 made of sheet metal which is formed in a square shape and surrounds the circuit board to hold the circuit board 26, a cover 31 made of sheet metal which is crowned on the frame 30 to cover the circuit board 26, and a connector cover 32 made of sheet metal which closes a cutout 31*a* of the cover 31. A plurality of spots of the frame 30 is fixed to the base plate 24 with the fixing screws 33. That is, the electronic circuit unit 21 of the satellite antenna device 200 is provided with the base plate 24 which detachably fixes the housing 27, and the base plate 24 is firmly fixed to the base plate 51 with the wet curable resin 34 (see FIG. 10).

To explain the construction of the respective parts of the satellite antenna device 200 in detail, the radiating conductor 22 is a patch electrode which is formed in a substantially square shape. Opposite ends of one diagonal line of the radiating conductor 22 is loaded with retraction and separation elements 22*a*. The ground conductor 23 is a ground electrode which is formed in a frame shape, and surrounds the radiating conductor 22 with predetermined spacing therefrom. The radiating conductor 22 and the ground conductor 23 are conductive layers made of good conductive metal such as Ag. As shown in FIG. 10, an inner conductor of the feeder line 25 is connected to the feeding point of the radiating conductor 22. Further, an outer conductor of the feeder line 25 is connected to the ground conductor 23.

The base plate 24 is formed in a rectangular shape so as to surround an opening 24*a*. Female screws 24*b* are provided in a standing manner at a plurality of spots of the base plate 24. Thus, the fixing screws 33 which have passed through the outwardly protruding pieces 30*a* are respectively fastened to the corresponding female screws 24*b* so that the frame 30 is fixed to the base plate 24 with screws. As shown in 10, the base plate 24 is fixed to the rear glass 51 with the wet curable resin 34 and double-sided adhesive tape 35. Here, the double-sided adhesive tape 35 is a temporary fixing means which is used until the wet curable resin 34 is cured.

As shown in FIG. 11, the square frame 30 is mainly constituted of a pair of mutually facing side walls 30*b* and 30*c*, and a pair of mutually facing side walls 30*d* and 30*e*. Longitudinal opposite ends of the side walls 30*b* and 30*c* are respectively provided with outwardly protruding pieces 30*a*. An end of the frame 30 which faces the rear glass 51 becomes a fitting portion 30*f* which is loosely fitted into the opening 24*a* of the base plate 24, and stoppers 30*g* which are formed adjacent to four corners of the fitting portion 30*f* is placed on the base plate 24 around the opening 24*a*. In this manner, the stoppers 30*g* at four corners of the fitting portions are brought into abutment against the base plate 24, whereby the insertion amount of the fitting portion 30*f* into the opening 24*a* is set to less than the thickness of the base plate 24. These stoppers 30*g* are formed at longitudinal opposite ends of each of the side walls 30*b* and 30*c* so as to slightly protrude from the side walls 30*d* and 30*e*. Further, a number of small holes 30*h* are formed around an end of the frame 30 opposite to the fitting portion 30*f* side.

As shown in FIG. 1A, since the rear glass 51 is assembled into the vehicle 50 as a window glass which is inclined with respect to the ground, when the frame 30 is fixed to the rear glass 51 by the base plate 24, the side wall 30*b* becomes the bottom region which is disposed on the ground side. Therefore, as shown in FIG. 14, the side wall 30*b* is provided with two circular drain holes 30*i* which allows the internals space to communicate with the external space. Further, each of the side walls 30*b* to 30*e* of the frame 30 is provided with a tongue piece 30*j* which is cut and bent toward the internal space (but, the tongue piece 30*j* before being bent is shown in drawings other than FIG. 11), and a clearance hole 30*k* required for forming the tongue 30*j*. The circuit board 26 is supported by these respective inwardly tongue pieces 30*j*. The clearance hole 30*k* provided in the side wall 30 also functions as a drain hole. These drain holes 30*i* and the clearance holes 30*k* which also functions as a drain hole, rapidly drain to the outside water drops which have penetrated into the internal space defined by the rear glass 51, the frame 30 and the back surface of the circuit board 26 so that the water drops do not remain in the internal space.

As shown in FIG. 11, one surface of the circuit board 26 becomes a component mounting surface 26*a* on which various electronic components (not shown) are mounted. The other end of the feeder line 25 having one end connected to the radiating conductor 22 and the ground conductor 23 is connected to the component mounting surface 26*a* by the connectors 36 and 37 which make a pair. That is, the other end of the feeder line 25 is connected to an input part of a pre-amplifying circuit. Further, one end of the coaxial cable 28 and one end of the DC cable 9 are respectively soldered to the component mounting surface 26*a*, and a connector 38 is attached to the other end of the coaxial cable 28. A plurality of spots of a peripheral edge of the component mounting surface 26*a* is soldered to the frame 30. This causes the frame 30 to electrically function as a ground, and the circuit board 26 and the frame 30 to be mechanically coupled with each other. The other surface (back surface) of the circuit board 26, that is, the surface of the circuit board 26 which faces the radiating conductor 22 and the ground conductor 23 becomes a radio wave reflecting surface 26*b* (see FIG. 13) in which a conductive layer made of good conductive metal such as Au is formed. The peripheral edge of the radio wave reflecting surface 26*b* is supported by the tongue pieces 30*j* of the frame 30 at plural spots.

Since the cover 31 is provided with the cutout 31*a* which is covered with the connector cover 32, and the connecter 37 is allowed to face the cutout 31*a*, the connector 36 of the feeder line 25 can be connected to the connector 37 at the circuit board 26 in a state where the cover 31 crowns the frame 30 which accommodates and the holds the circuit board 26. Almost the entire periphery of the cover 31 is provided with a bent piece 31*b* which fits on the side walls 30*b* to 30*e* of the frame 30. The bent piece 31*b* is provided with a number of small engaging protrusions 31*c* which protrude inwardly. These small engaging protrusions 31*c* are arranged at positions corresponding to the small holes 30*h* of the frame 30, and the respective small engaging protrusions 31*c* can be press-fitted into the corresponding small holes 30*h* by the elasticity of the bent piece 31*b*. Accordingly, the frame 30 can be simply crowned with the cover 31 by snap fitting. In addition, the circuit board 26 is assembled into the frame 30 before being crowned with the cover 31 so that the assembling work of the circuit board 26 can be easily performed.

When the frame 30 crowned with the cover 31 is fixed to the rear glass 51 by the base plate 24, since the region of the cover 31 around the side wall 30*b* of the frame 30 becomes a bottom region to be disposed on the ground side, the cover 31 is provided at four spots of the region with drain holes 31*d*. These drain holes 31*d* rapidly drain to the outside water drops which have penetrated into the internal space defined by the component mounting surface 26*a* of the circuit board 26, the frame 30, the cover 31, and the connector cover 32 so that the water drops do not remain in the internal space.

The process of assembling the satellite antenna device 200 constructed as above will now be described below. First, the radiating conductor 22 and the ground conductor 23 are formed on the inner surface of the glass plate to be the rear glass 51, one end of the feeder line 25 is soldered to the predetermined positions of the radiating conductor 22 and the ground conductor 23. Then, after the base plate 24 is firmly fixed to the inner surface of the glass plate with the wet curable resin 34, the frame 30 which has been positioned by inserting the fitting portion 30*f* into the opening 24*a* is fixed to the female screw 24*b* of the base plate 24 with the fixing screws 33. It is noted herein that the circuit board 26 is assembled into the frame 30 in advance to solder one end of each of the coaxial cable 28 and the DC cable 9, and is crowned with the cover 31. Further, when the frame 30 is fixed to the base plate 24 with screws, the feeder line 25 is drawn out of the frame 30 using the relief groove 30*m* (see FIG. 11) formed in the side wall 30*d*. Then, after the frame 30 is fixed to the base plate 24, the connector 36 attached to the other end of the feeder line 25 is connected to the connector 37 at the circuit board 26 which faces the cutout 31*a* of the cover 31. Thereafter, the connector cover 32 is attached to the cover 31 to cover the cutout 31*a*, thereby completing the attaching work of the electronic circuit unit 21 to the glass plate to be rear glass 51.

Next, the unique effects of the above-described embodiment will be described. First, to explain the unique effects of the ground-based station antenna device 100, since the connecting portion between the respective soldering portions 4*a* of the base plate 4 and other portion defines the small space 4*e*, and thus the heat generated when the base plate 4 is soldered to the radiating conductor 2 is hardly transferred to the other portion, the soldering work can be completed in a short time. Moreover, since the respective soldering portions 4*a* are provided with the bulging portions 4*c* and the solder stay spaces are defined around the bulging portions 4*c*, strength reduction caused by shortage of the adhesion amount of solder can be avoided so that soldering connecting can be performed with high reliability.

Further, in the ground-based station antenna device 100, since the angle holding member 15 is attached to the back surface of the reflecting plate 3, and the abutting side edges 15*a* with high dimensional accuracy are brought into abutment against the back surface of the reflecting plate 3 and the flat surface of the base plate 4 so that the inclination angle of the reflecting plate 3 with respect to the glass plate (rear glass) 51 can be specified with high accuracy, desired antenna performance can be easily obtained. Moreover, since the angle holding member 15 is attached to remarkably increase the mechanical strength of the reflecting plate 3, even if an external force is applied during assembling, there is little risk that the reflecting plate 3 is undesirably deformed, which also improved the reliability.

Further, according to the ground-based station antenna device 100, since the feeder line 5 having one end connected to the feeding point of the radiating conductor 2 is inserted between the holding piece 4*g* and the glass plate (the rear glass) 51 so that the position can be regulated, and the position of the feeder line 5 can be regulated by the hooking piece 4*h* or the holding groove 11*e* even outside the housing 7, the feeder line 5 can be efficiently led along a predetermined path.

Further, according to the ground-based station antenna device 100, since the coaxial cable 8 can be hooked on the arm 10*f* which is provided in the frame 10 to protrude therefrom, the posture of the coaxial cable 8 can be stabilized during the assembling work, and damage to a connected portion of the coaxial cable 8 which may be caused when a tension acts on the coaxial cable can be avoided. Further, the arm 10*f* composed of a metallic piece is properly deformed so that the posture of the coaxial cable 8 can be simply modified. Moreover, the fixing work of the coaxial cable 8 can be very simply performed without using binders, adhesive tapes, or the like.

Further, since the ground-based station antenna device 100 employs an attachment structure in which the frame 10 having the circuit board 6 accommodated and held therein is fixed by screws to the base plate 4 which has been fixed to the glass plate (the rear glass) 51 in advance, a troublesome removal work or attachment work during checking or replacement of the circuit board 6 need not be performed, so that the maintenance can be easily performed.

Further, in the ground-based station antenna device 100, the frame 10 and the cover 11 that constitutes the housing 7 are respectively formed with drain holes 10*i* and 11*d*. Since these drains holes 10*i* and 11*d* are arranged in the vicinity of the lowermost portions of the electronic circuit unit 1 which is attached to the rear glass 51 inclined with respect to the ground surface, there is no fear that, even if water drops penetrates the housing 7, the component mounting surface 6*a* of the circuit board 6 is be submerged in water. As a result, in the ground-based station antenna device 100, malfunction or failures caused by the penetration of water drops hardly occurs, and thus high reliability can be expected for a prolonged period of time.

Next, to explain the unique effects of the satellite antenna device 200, since the back surface of the circuit board 26 becomes the radio wave reflecting plate 26*b* which faces the radiating conductor 22 and the ground conductor 23, the radiating gain in the direction of arrival of radio waves can be increased. In this case, the height position of the radio wave reflecting plate 26*b* with respect to the radiating conductor 22 and the ground conductor 23 is required to be specified with high accuracy. However, in the present embodiment, since the frame 30 having the circuit board 26 accommodated and held therein is positioned in the in-plane direction of the base plate 24 by the fitting portions 30*f* and positioned in the thickness direction of the base plate 24 by the stoppers 30*g*, if the frame 30 is attached to the base plate 24, the circuit board 26 can be automatically disposed at a predetermined position and thus the height position of the circuit board 26 with respect to the radiating conductor 22 can be specified with high accuracy. Further, there is no fear that an undesired gap occurs between the frame 30 and the base plate 24. That is, since the electronic circuit unit 21 of the satellite antenna device 200 has an assembling structure in which the height position of the radio wave reflecting plate 26*b* can be specified with high accuracy, excellent antenna performance can be expected. In addition, since the frame 30 has a simple shape and is worked simply and easily, the dimensional accuracy of the fitting portion 30*f* and the stoppers 30*g* also is easily improved.

Similar to the ground-based station antenna device 100, even in the satellite antenna device 200, the frame 30 and the cover 31 that constitute the housing 27 are respectively formed with the drain holes 30*i* and the clearance holes 30*k* which also functions as a drain hole 31*d*. Since the drain holes 30*i* and 30*d* or the clearance holes 30*k* are arranged in the vicinity of the lowermost portions of the electronic circuit unit 21 attached to the rear glass 51 inclined with respect to the ground surface, even if water drops penetrates the housing 27, there is no fear that the component mounting surface 26*a* or radio wave reflecting plate 26*b* of the circuit board 26 may be submerged in water. As a result, in the satellite antenna device 200, malfunction or failures caused by the penetration of water drops hardly occurs, and thus high reliability can be expected for a prolonged period of time.

Similar to the ground-based station antenna device 100, since the satellite antenna device 200 also employs an attachment structure in which the frame 30 having the circuit board 26 accommodated and held therein is fixed by screws to the base plate 24 which has been fixed to the glass plate (the rear glass) 51 in advance, a troublesome removal work or attachment work during checking or replacement of the circuit board 26 need not be performed, so that the maintenance can be easily performed.

In addition, although the present embodiment has been described with respect to the vehicle-mounted antenna system in which the ground-based station antenna device 100 and the satellite antenna device 200 that operate in a mutually complementary manner are placed side by side, the present invention is not limited thereto and may be applied to a vehicle-mounted antenna system constituted of only any one of the antenna devices. Further, the present invention may be applied to a vehicle-mounted antenna system which is used while being mounted on a front glass or the like of a vehicle in addition to the rear glass of the vehicle.

The invention claimed is:

1. A wiring structure of a vehicle-mounted antenna system comprising:

a glass plate disposed in a vehicle as a window glass;

a radiating conductor formed on an inner surface of the glass plate which faces an interior of the vehicle;

a coaxial feeder line having one end connected to a feeding point of the radiating conductor;

a base plate made of sheet metal and fixed to the inner surface of the glass plate;

a circuit board to which the other end of the feeder line is connected; and a housing attached to the base plate after accommodating the circuit board, wherein the base plate is provided with a holding piece which is spaced apart from the glass plate so as to protrude into the housing and faces the glass plate, and a portion of the feeder line which extends along the glass plate from the one end of the feeder line is engaged with the holding piece, and the housing includes a sheet metal frame that surrounds and holds the circuit board, and is detachably fixed to the base plate, and a sheet metal cover that is crowned on the frame so as to cover the circuit board.

2. The wiring structure of a vehicle-mounted antenna system according to claim 1, wherein the base plate is provided with a hooking piece which is spaced apart from the glass plate so as to protrude out of the housing, a portion of the feeder line which is led out of the housing is hooked on the hooking piece.

3. The wiring structure of a vehicle-mounted antenna system according to claim 1, wherein a peripheral portion of the cover is provided with a bent piece which fits on the frame, and a portion of the bent piece is provided with a holding groove for positioning a portion in proximity of the other end of the feeder line.

4. The wiring structure of a vehicle-mounted antenna system according to claim 1, wherein the other end of the feeder line is connected to the circuit board by a connector.

* * * * *